United States Patent [19]

Biagi et al.

[11] Patent Number: 4,494,317

[45] Date of Patent: Jan. 22, 1985

[54] ACCESSORY DEVICE FOR REMOVING SOLVENT VAPOR IN MACHINES FOR DRY CLEANING GARMENTS AND THE LIKE

[75] Inventors: Gino Biagi, Calderara di Reno; Vincenzo Fini, Sala Bolognese, both of Italy

[73] Assignee: Firbimatic S.R.L., Italy

[21] Appl. No.: 492,413

[22] Filed: May 6, 1983

[30] Foreign Application Priority Data

Jan. 24, 1983 [IT] Italy ..... 3314 A/83

[51] Int. Cl.[3] ..... F26B 21/06

[52] U.S. Cl. ..... 34/73; 34/76; 34/77; 68/18 C; 62/199

[58] Field of Search ..... 34/73, 76, 77; 62/199, 62/402, 434; 68/18 C, 18 R

[56] References Cited

U.S. PATENT DOCUMENTS

| | | | |
|---|---|---|---|
| 2,133,949 | 10/1938 | Buchanan | 62/199 |
| 2,466,460 | 4/1949 | Marshall | 62/434 |
| 2,726,658 | 12/1955 | Chessey | 62/434 |
| 3,807,948 | 4/1974 | Moore | 68/18 C |
| 4,370,816 | 2/1983 | Zambelli | 34/77 |

*Primary Examiner*—Larry I. Schwartz

*Assistant Examiner*—David W. Westphal

*Attorney, Agent, or Firm*—Darby & Darby

[57] ABSTRACT

Disclosed herein is a device that comprises a refrigeration plant with two distinct evaporators, one parallel with the other, which can be supplied separately to suit the operating cycle of the dry cleaning machine on which the device is mounted and are housed in a corresponding first and a corresponding second jacket.

The first jacket is placed in a closed circuit through which passes a forced circulation of liquid and in which is provided the nest of tubes belonging to the condenser mounted in the closed drying circuit of the machine. Heat is given to the said liquid by the solvent vapor and water which, as they pass across the condenser, are cooled and condensed, and the liquid is cooled by the evaporator housed in the first jacket.

Jointly with the deodorizing circuit of the said machine, the second jacket defines a closed circuit; the evaporator concerned cools the air-solvent vapor-water mixture that circulates in the said closed circuit, and this allows the condensation to take place of the said vapor and renders possible the recovery of the solvent contained therein.

2 Claims, 4 Drawing Figures

FIG. 1
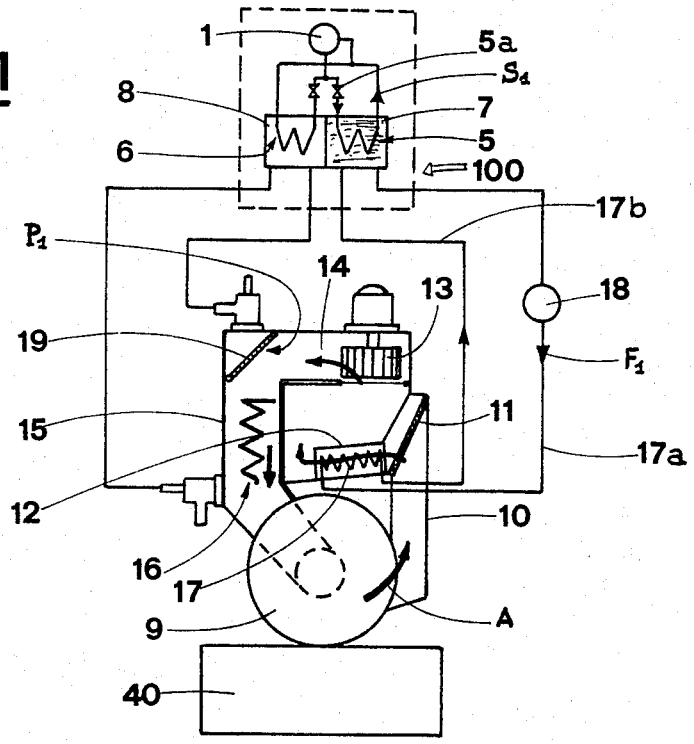
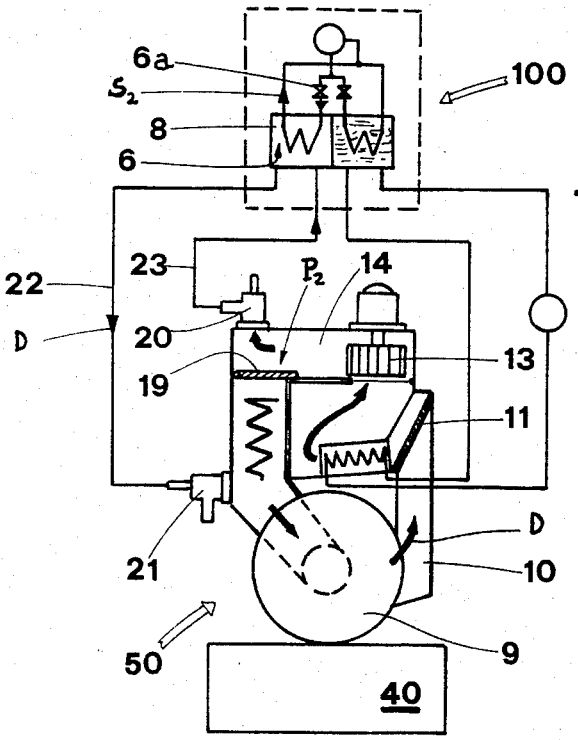
FIG. 2

ACCESSORY DEVICE FOR REMOVING SOLVENT VAPOR IN MACHINES FOR DRY CLEANING GARMENTS AND THE LIKE

BACKGROUND OF THE INVENTION

The invention relates to an accessory device intended for dry cleaning machines whose drying and deodorizing circuit is of what is known as the "normally open" type, and not only is the device original but it is particularly interesting since, with the utmost ease, it can also be fitted on prior installed machines without the need for them to be in any way especially adapted.

DESCRIPTION OF THE PRIOR ART

In the machines of the type mentioned above, once the solvent bath has been discharged out of the washing tank, it is necessary to proceed with the drying of the garments placed in the said tank.

For this purpose, a closed circuit drying circuit is provided and, in the order stated, this comprises among other things, the said tank, a filter, a surface condenser, a fan and a heater. The hot air that hits the solvent and water impregnated garments brings about the evaporation of the solvent and water vapor. When the said vapor comes into contact with the condenser, it is cooled and, in part, condensed and this, once the water has been separated from the solvent, enables the latter to be recovered.

Through the nest of tubes of the said condenser passes the forced circulation (achieved by means of a pump) of a liquid.

In one first known solution, the nest of tubes is, on one side, connected to the urban water mains, while the other side thereof discharges into the drains. It is obvious in this case that the consumption of water is considerable and that there is a constant danger of the water table undergoing pollution due to the imperfect sealing of the nest of tubes and the consequent infiltration of a solvent (constituted by perchloroethylene, trichloroethylene or trichloroethane) into the discharge water.

To overcome the aforementioned problems, closed circuits have been designed that include the nest of tubes and devices for cooling the water issuing from this, for example: by means of heat exchangers of the "evaporative" type or by making full use of the evaporator of a refrigeration plant; to experts in the field it is quite apparent that a solution of this nature is complex and onerous.

The drying operation has necessarily to be followed by what is called the deodorizing operation which is attended to by a suitable open circuit accessible from the outside through two apertures, one of which for the supply of air and the other for the discharge of this. In the order stated, the said circuit (defined by suitable members to which the operating cycle of the machine is interlocked) comprises, among other things, starting at the infeed aperture, the said washing tank, the said filter and the said fan.

As the flow of air that is created, supported by the fan, from the infeed aperture towards the discharge aperture, crosses the washing tank, it carries with it the solvent and water vapor contained therein.

In one first embodiment, the said flow is discharged directly to the outside (for example: by means of a pipe) with a consequent loss of solvent and the pollution of the atmosphere.

In other embodiments, devices for removing the solvent vapor (for example: suitably cooled beds of gravel, activated carbon etcetera) are placed in series with the discharge aperture; the complexity and the cost of these devices are known to experts in the field.

SUMMARY OF THE INVENTION

The object of the invention is to make available an accessory device for dry cleaning machines so constructed as to allow it to be connected both to the said nest of tubes in order to avoid the consumption of the liquid circulating therein and to cool the said liquid, and to the said deodorizing circuit apertures so that the discharge into the atmosphere of the solvent vapor be prevented and, at the same time, the said solvent be recovered, with everything being achieved through the use of an original technical solution, the reliability of which is certain.

A further object of the invention is to make available the said device so constructed as to give an optimal performance with a minimum consumption of energy.

Another object still of the invention is to make available the said device so constructed as to be able to be used also in prior installed machines.

The said objects are achieved with the device according to the invention for removing solvent vapor in machines for dry cleaning garments and the like provided with a closed drying circuit comprising, in the order stated, among other things, a washing tank, a filter, a surface condenser for the recovery of the solvent vapor, the nest of tubes of which is connected to the outside by means of pipes for delivering and discharging a fluid circulating therein, a fan and a heater, and also provided with an open deodorizing circuit that communicates with the outside via two apertures, one of which for supplying air therein and the other for discharging a mixture of air, solvent vapor and water there from, the said deodorizing circuit comprising, in the order stated, among other things, starting at the infeed aperture, the said washing tank, the said filter and the said fan; the said device comprising a refrigeration circuit provided with at least two distinct evaporators, one parallel with the other and able to be supplied separately in consequence of the opening of the corresponding cut-off valves interlocked to the operating cycle of the dry cleaning machine concerned, the said evaporators being housed in a corresponding first and a corresponding second jacket, respectively, the first of which connected to the delivery and discharge pipes of the said nest of pipes so as to define a closed circuit for supplying the said nest of pipes with the said fluid and for cooling, in the said first jacket, the said fluid, and the second of which connected to the said apertures for supplying and discharging the deodorizing circuit, so as to define a closed circuit within the open deodorizing circuit and also to enable, in the said second jacket, the mixture of gases passing through the deodorizing circuit as defined above, to be cooled and the said solvent vapor to be consequently condensed.

In order to limit the potentiality of the refrigeration plant, provision is made for an air-air crossed flow heat exchanger in which the first input is connected to the said deodorizing circuit discharge aperture, the first output is connected to the inlet to the said second jacket, the second input is connected to the outlet of the latter, and the second output is connected to the aforementioned deodorizing circuit supply aperture.

BRIEF DESCRIPTION OF THE DRAWINGS

The characteristics of the device according to the invention that are not apparent from the foregoing description are emphasized in the text that follows, with reference to the accompanying tables of drawings, in which:

FIGS. 1 and 2 show, in diagrammatic form, the accessory device according to the invention and the dry cleaning machine with which it is used, during the drying operation and during the deodorization thereof;

DESCRIPTION OF THE PREFERRED EMBODIMENT

Figure 3:
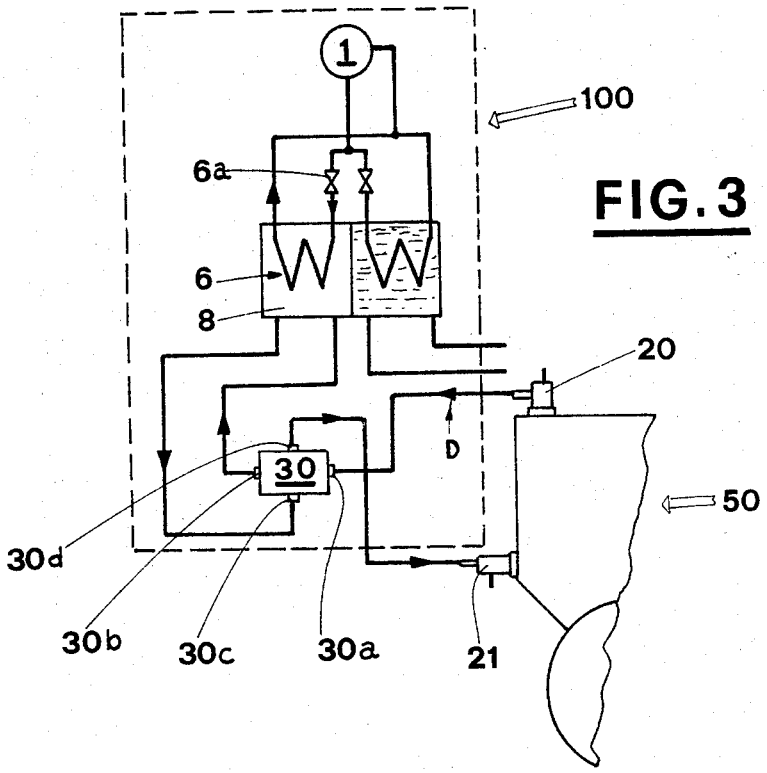
FIG. 3 shows, diagrammatically, one variant for the device in question.

With reference to the above listed figures, at 100 has been shown the device according to the invention which, in a first embodiment (FIGS. 1, 2 and 4), is defined by a refrigeration plant that comprises, in the order stated, among other things, a compressor 1, a condenser 2 (air cooled), a tank 3, a filter 4 and, what is of notable importance, two distinct evaporators 5 and 6, one parallel with the other and able to be supplied separately in consequence of the opening of the corresponding cut-off valves 5*a* and 6*a* interlocked, in a known fashion, to the operating cycle of a dry cleaning machine, shown at 50, to which the device 100 is connected.

The evaporators 5 and 6 are housed in corresponding jackets 7 and 8, through the one numbered 7 of which (for reasons outlined hereinafter) passes a liquid solution (with a prevalently water base), while through the one numbered 8 of which passes (again for reasons outlined hereinafter) a mixture of gases.

In FIG. 1, for the machine 50 shown diagrammatically, stress has been given to the drying circuit thereof.

The said circuit, which is of the closed type, comprises in the order stated, among other things, a washing tank 9, a vertical pipe 10, a filter 11, a surface condenser 12 (of the air-liquid type), a fan 13, a pipe 14 and a pipe 15 inside which is placed a heater 16.

The nest of pipes 17 of the condenser 12 is connected, through a delivery pipe 17*a* (including a pump 18) and a discharge pipe 17*b*, to the said jacket 7; in this way, the jacket 7, the said pipes and the nest of pipes 17 define a closed circuit.

Emphasis has been given, in the diagrammatic representation as per FIG. 2, to the deodorizing circuit of the machine 50.

In order to define the said deodorizing circuit, it is necessary to displace (using known non-illustrated means) a dividing wall 19 from position $P_1$ in FIG. 1 (in which the pipes 14 and 15 communicate freely) to position $P_2$ (in which the passage between the said pipes is closed), as well as to render the pipe 15 in communication with the outside, through an infeed aperture 21 (previously closed since it includes a non-illustrated cut-off valve) and, similarly, to render the pipe 14 in communication with the outside, through a discharge aperture 20.

The part of the deodorizing circuit inside the machine 50 (see FIG. 2) comprises, in the order stated, among other things, starting at the aperture 21, the tank 9, the pipe 10, the filter 11, the fan 13, the pipe 14 and the aperture 20. The said circuit is completed (in such a way as to render it closed) by pipes 22 and 23 that are destined to connect the apertures 21 and 20, respectively, with the jacket 8 containing the evaporator 6.

Figure 4:
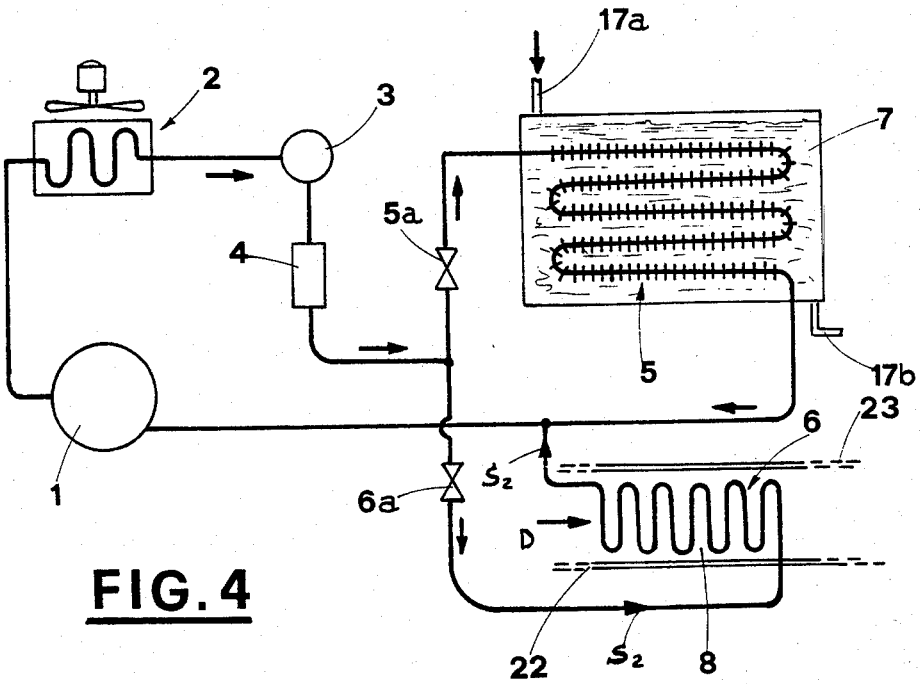
FIG. 4 shows, diagrammatically in a functional diagram, the refrigeration plant of the device in question.

A description will now be given of the operation of the device in question, with reference to FIGS. 1, 2 and 4.

As is known, after the solvent bath has been discharged from the tank 9 it is necessary to proceed with the drying of the garments placed in the said tank. For this operation, the valve 5*a* is opened, the pump 18 and the fan 13 are set in motion and the dividing wall 19 is displaced into position $P_1$. How the said devices are actuated is not described herein since it is not pertient to the subject matter.

The foregoing necessitates the creation of a flow of liquid $S_1$ through the evaporator 5, of a flow of liquid $F_1$ through the jacket 7 and the nest of tubes 17, and of a flow A in the drying circuit as depicted in FIG. 1.

As the flow A, warmed by the heater 16, hits the garments, the evaporation is caused of the solvent and water with which they are impregnated; in this way a mixture is formed of air, solvent vapor and water.

Passing through the condenser 12, the said vapor mixture is cooled and condensed and thus it consequently yields heat to the flow of liquid $F_1$. The solvent and water condensate is sent to a non-illustrated separator that attends to "extracting" the solvent which is subsequently sent into a tank 40.

The flow A, thus cooled, recirculates once it has been warmed by the heater 16.

Since the flow $F_1$ increases, as it passes through the nest of pipes 17, in temperature, steps have to be taken to cool it and this is achieved by the evaporator 5. In this way, the heat yielded to the flow $F_1$ by the vapor that condenses is given up to the evaporator 5 by the said flow.

Once the percentage of solvent vapor in the flow A is below an established value, the heater 16 has to be taken out of operation, the valve 5*a* closed, the valve 6*a* opened and the dividing wall 19 displaced into position $P_2$ (FIG. 2). As regards the pump 18, it can be left running for a short time until the outside surface temperature of the nest of pipes is no longer such as to allow the condensation of the vapor, and then at that moment it can be taken out of operation.

Through the action of the fan 13, a flow D is formed in the previously described deodorizing circuit, and this is constituted by a mixture of air and vaporized solvent. As the said flow hits the still warm garments, it is charged with solvent vapor (and water) and it passes out of the aperture 20 at a temperature of around, for example, 50° C.

The said flow hits the evaporator 6 as it passes through the jacket 8, and this brings about the cooling and the condensation of part of the said vaporized mixture. The solvent-water condensate collects at the bottom of the jacket and using known non-illustrated means, the separation takes place of the solvent from the water with the former being recovered.

The flow D, which when leaving the jacket 8 is of a temperature of around 30°–35° C., goes back again into the tank 9 and this is repeated until the deodorizing operation has been brought to a conclusion.

It is stressed that the time generally needed for the drying operation requires a certain potentiality (units of refrigeration) for the evaporator 5 and a corresponding power for the compressor 1. Likewise, the time generally needed for the deodorizing operation requires a corresponding potentiality for the evaporator 6, greater than that of the evaporator 5 and this necessitates the compressor 1 power being greater than the power required for the evaporator 5. Since there is only one compressor, it would be oversized for the first situation.

With a view to rendering the operation of the compressor optimal and, at the same time, limiting the potentiality of the evaporator 6, the variant illustrated in FIG. 3 is envisaged.

In the said figure, at 30 has been shown a static heat exchanger (the operation of which requires no power) of the air-air crossed flow type. The first input 30*a* of the exchanger is connected to the aperture 20, while the first output 30*b* is connected to the jacket 8. The flow D from the latter is sent to the second input 30*c* of the heat exchanger 30 from which it passes out through a second output 30*d* for it then to be channelled into the aperture 21.

By way of an example, between the input 30*a* and the output 30*b* there is a decrease in temperature of approximately 10° C. (from 50° C. to 40° C. circa), and an identical drop in temperature is caused in the flow D when passing through the jacket 7 (from 40° C. to 30° C. circa). Between the input 30*c* and the output 30*d* there is a rise in temperature of approximately 10° C. (from 30° C. to 40° C.).

The temperature of the flow D that goes into the aperture 21 is approximately 10° C. less than the temperature of the flow that passes out of the aperture 20, and the said difference is sufficient for the deodorizing operation to be completed within the time span normally required for the said operation.

In the variant outlined in FIG. 3, the difference in temperature that the evaporator 6 has to give to the flow D (between the inlet and the outlet of the jacket 7) is less than that required for the first embodiment considered. This makes it possible to limit the potentiality of the evaporator 6 at a value such as to uniform the power required for the compressor 1 with the requirements of the other evaporator 5, thereby affecting positively both the cost of the refrigeration plant and the power consumption of this.

To recapitulate, the accessory device described herein for dry cleaning machines either cools the liquid circulating in the nest of tubes of the condenser, by means of a closed circuit (thus with an absence of the consumption of water and the impossibility of polluting the discharge waters, as in the previously known solutions) or it defines a closed circuit for the deodorization of the garments. In the last mentioned operation, the discharge is prevented of solvent into the atmosphere and the removal and recovery is made possible of the solvent vapor still present during the deodorizing operation.

It should be noted that the device described herein is connected to the machine 50 through the pipes 17*a*, 17*b*, 22 and 23, that is to say, without any modification to the said machine being required. This is especially advantageous since it makes it possible for the device in question to be fitted to previously installed machines.

The foregoing description has been given purely as an unlimited example and thus all eventual variants of a constructional nature can be taken as falling within the technical framework of the invention as described above and claimed hereinafter.

What is claimed is:

1. Apparatus for removing solvent vapor in machines for dry cleaning garments and the like, in which said machines are provided with a closed drying circuit comprising a washing tank, a filter, and a surface condenser for the recovery of the solvent vapor, said condenser including tube means, pipe means connected to said tube means for delivering and discharging a fluid circulating therein, a fan, a heater, and a deodorizing circuit formed with two apertures by which said machine communicates with said apparatus, one of which apertures supplies air to said machine and the other of which apertures discharges a mixture of air, solvent vapor and water from said machine, said deodorizing circuit comprising said washing tank, said filter and said fan; and said apparatus comprising:

a refrigeration circuit including at least two distinct evaporators connected in parallel, a pair of cut-off valves interlocked to the operating cycle of the dry cleaning machine and respectively connected to said evaporators, a pair of jackets respectively enclosing said evaporators, a first of said jackets being connected to said pipe means so as to define a first closed circuit for supplying the tube means with said fluid and for cooling said fluid in said first jacket, the second of said jackets being connected to said apertures so as to define with said deodorizing circuit a second closed circuit and also to enable cooling of the mixture of gases passing through said deodorizing circuit and condensing of said solvent vapor in said second jacket.

2. Apparatus according to claim 1 comprising an air-air crossed flow heat exchanger having a first input connected to said discharge aperture of the deodorizing circuit, a first output supplying an input to said second jacket, a second input receiving an output of said second jacket, and a second output connected to said supply aperture of said deodorizing circuit.

* * * * *